US007824199B2

(12) United States Patent
Kikuchi et al.

(10) Patent No.: US 7,824,199 B2
(45) Date of Patent: Nov. 2, 2010

(54) CONNECTOR

(75) Inventors: Masayuki Kikuchi, Tokyo (JP); Kazushi Kamata, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/321,110

(22) Filed: Jan. 15, 2009

(65) Prior Publication Data

US 2009/0186508 A1 Jul. 23, 2009

(30) Foreign Application Priority Data

Jan. 17, 2008 (JP) ..... 2008-008478

(51) Int. Cl.
*H01R 13/62* (2006.01)

(52) U.S. Cl. ..... 439/159; 439/352; 439/157

(58) Field of Classification Search ..... 439/352, 439/358, 159, 157
See application file for complete search history.

(56) References Cited

U.S. PATENT DOCUMENTS 4,002,389 A * 1/1977 Mammel ..... 439/352
6,517,372 B1 * 2/2003 Jones ..... 439/346
6,945,808 B1 9/2005 Hisamatsu
6,953,356 B2 * 10/2005 Hisamatsu et al. ..... 439/258
7,455,539 B2 * 11/2008 Gunther et al. ..... 439/160
7,503,795 B2 * 3/2009 Yamaji et al. ..... 439/358
2003/0228788 A1 * 12/2003 Igarashi et al. ..... 439/358

FOREIGN PATENT DOCUMENTS

JP 2005-267970 9/2005

* cited by examiner

*Primary Examiner*—Truc T Nguyen
(74) *Attorney, Agent, or Firm*—Collard & Roe, P.C.

(57) ABSTRACT

A connector is matable with a mating connector which has an engaged portion. The connector comprises a support portion and a lock member pivotally supported by the support portion. The lock member comprises a body portion, a lock portion, a spring portion and an operated portion. The body portion comprises a first predetermined portion which has a plate-like shape and is pivotally supported by the support portion. The lock portion is movable between a lock position and a release position in response to a pivotal movement of the body portion. The lock portion comprises an engaging portion engagable with the engaged portion. The engagement of the engaging portion with the engaged portion is locked when the lock portion is positioned at the lock position, while the engagement is released when the lock portion is positioned at the release position. The spring portion urges the lock portion to move toward the lock position. The spring portion extends from the body portion and has a second predetermined portion, which is parallel to the first predetermined portion but is different in position from the first predetermined portion in a direction perpendicular to the first and the second predetermined portions. The operated portion is formed and arranged to force the lock portion to move to the release position when the operated portion is operated.

10 Claims, 9 Drawing Sheets

CONNECTOR

CROSS REFERENCE TO RELATED APPLICATIONS

Applicants claim priority under 35 U.S.C. §119 of Japanese Application No. JP2008-008478 filed Jan. 17, 2008.

BACKGROUND OF THE INVENTION

This invention relates to a connector matable with a mating connector. In particular, this invention relates to the connector comprising a lock member which engages with an engaged portion of the mating connector to lock a mating state of the connector with the mating connector.

A connector of this type is disclosed in JP-A 2005-267970, the contents of which are incorporated herein by reference. The disclosed connector comprises a lock member which can pivotally move. The lock member comprises a lock portion, a spring portion and an operated portion. The lock portion is provided with a hook which is engaged with an engaged portion of a mating connector when the lock portion is positioned at a lock position. The spring portion presses the lock portion toward the lock position. The operated portion is formed and arranged to force the lock portion to move to a release position when the operated portion is operated.

A small-sized lock member contributes to size reduction of a connector. The spring portion of the small-sized lock member normally has a reduced spring force. There is a need for a connector comprising a lock member which is small-sized but can provide a sufficient spring force.

SUMMARY OF THE INVENTION

One aspect of the present invention provides a connector matable with a mating connector. The mating connector has an engaged portion. The connector comprises a support portion and a lock member pivotally supported by the support portion. The lock member comprises a body portion, a lock portion, a spring portion and an operated portion. The body portion comprises a first predetermined portion. The first predetermined portion has a plate-like shape and is supported by the support portion so that the first predetermined portion is pivotally movable around the support portion. The lock portion is movable between a lock position and a release position in response to a pivotal movement of the body portion. The lock portion comprises an engaging portion which is engagable with the engaged portion. The engagement of the engaging portion with the engaged portion is locked when the lock portion is positioned at the lock position, while the engagement is released when the lock portion is positioned at the release position. The spring portion urges the lock portion to move toward the lock position. The spring portion extends from the body portion. The spring portion has a second predetermined portion. The second predetermined portion is parallel to the first predetermined portion but is different in position from the first predetermined portion in a predetermined direction perpendicular to the first and the second predetermined portions. The operated portion is formed and arranged to force the lock portion to move to the release position when the operated portion is operated.

An appreciation of the objectives of the present invention and a more complete understanding of its structure may be had by studying the following description of the preferred embodiment and by referring to the accompanying drawings.

Figure 1:
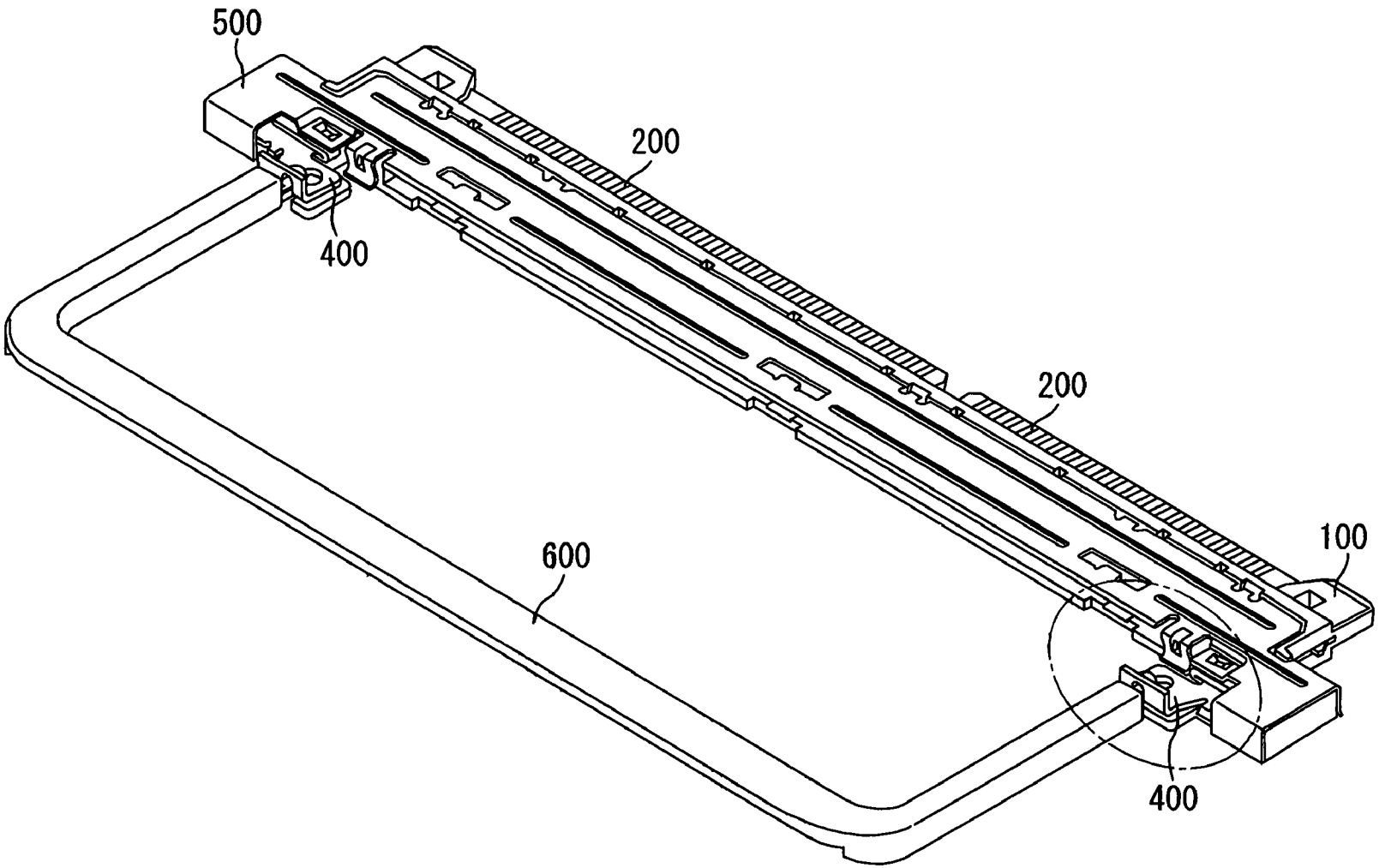
FIG. 1 is a perspective view showing a combination of a plug connector and an aid tool therefor in accordance with an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
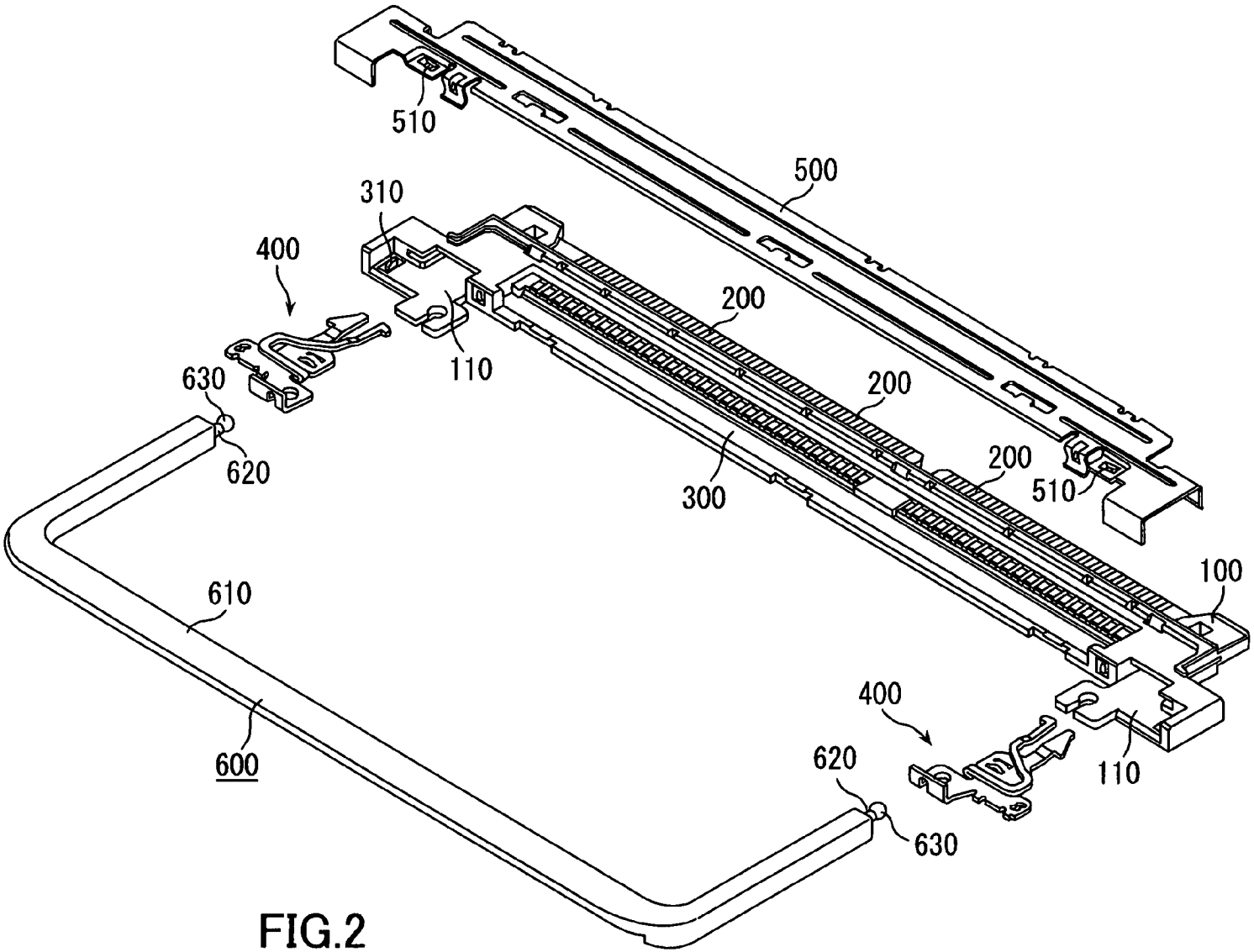
FIG. 2 is an exploded, perspective view showing the combination of FIG. 1.
Figure 3:
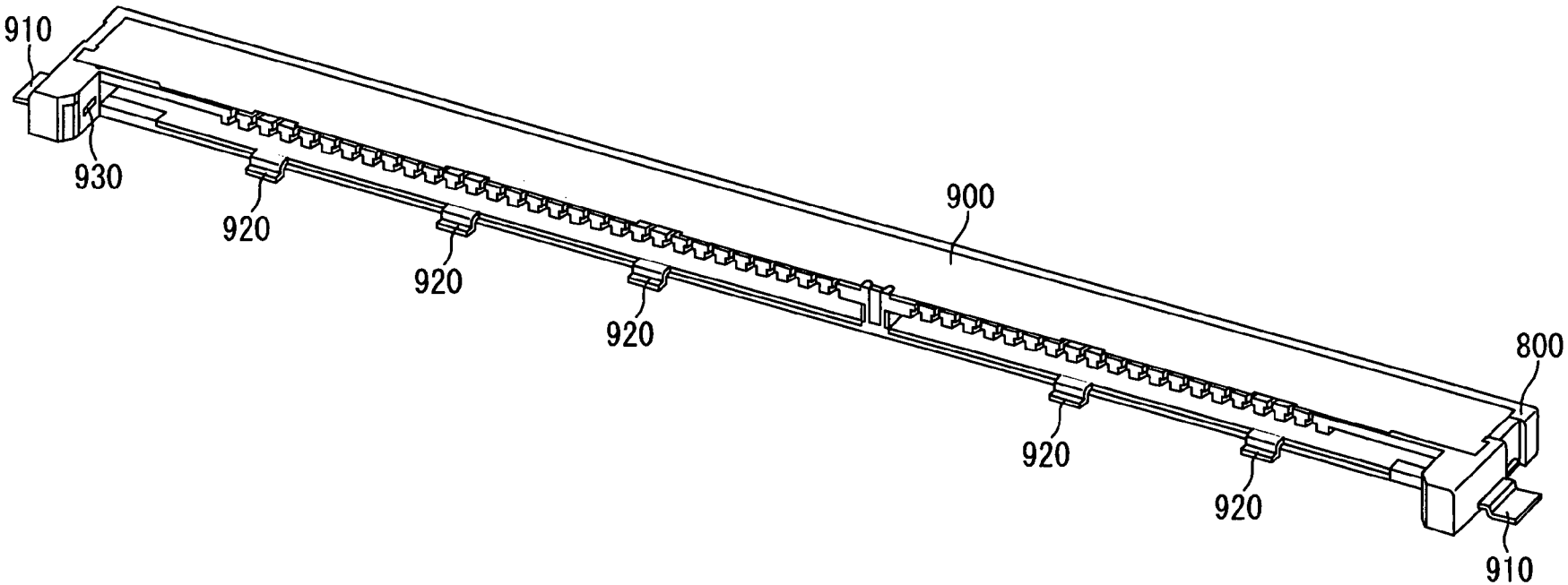
FIG. 3 is a perspective view showing a receptacle connector which is matable with the plug connector of FIG. 1.

With reference to FIGS. 1 and 2, a connector according to an embodiment of the present invention is a plug connector. The plug connector is matable with a receptacle connector of FIG. 3. The receptacle connector comprises an insulator 800, a shell 900 and a plurality of contacts (not shown). The insulator 800 holds the contacts. The shell 900 is held by the insulator 800 simultaneously upon a formation of the insulator 800 through an insert-molding process. The shell 900 is provided with fixed portions 910, 920. The fixed portions 910, 920 are fixed by soldering to a circuit board (not shown) so that the receptacle connector is mounted and fixed on the circuit board. The shell 900 is further provided with engaged portions 930. Each of the engaged portions 930 is a slit extending along a direction along which the plug connector is matable with the receptacle connector. The receptacle connector has a fit portion with which the plug connector is fit. The engaged portions 930 are formed on the fit portion of the receptacle connector and are positioned in the vicinity of opposite ends in a longitudinal direction of the receptacle connector.

As shown in FIGS. 1 and 2, the plug connector of the present embodiment comprises an insulator 100, a plurality of contacts 200, a base shell 300, lock members 400 and a cover shell 500. The contacts 200 and the base shell 300 are held by the insulator 100 simultaneously upon a formation of the insulator 100 through an insert-molding process. The lock members 400 serve, in cooperation with the engaged portions 930, to lock a mating state of the plug connector with the receptacle connector. The lock members 400 are operated by using an aid tool 600 so that the locking of the mating state is released, as explained in detail afterwards.

Figure 5:
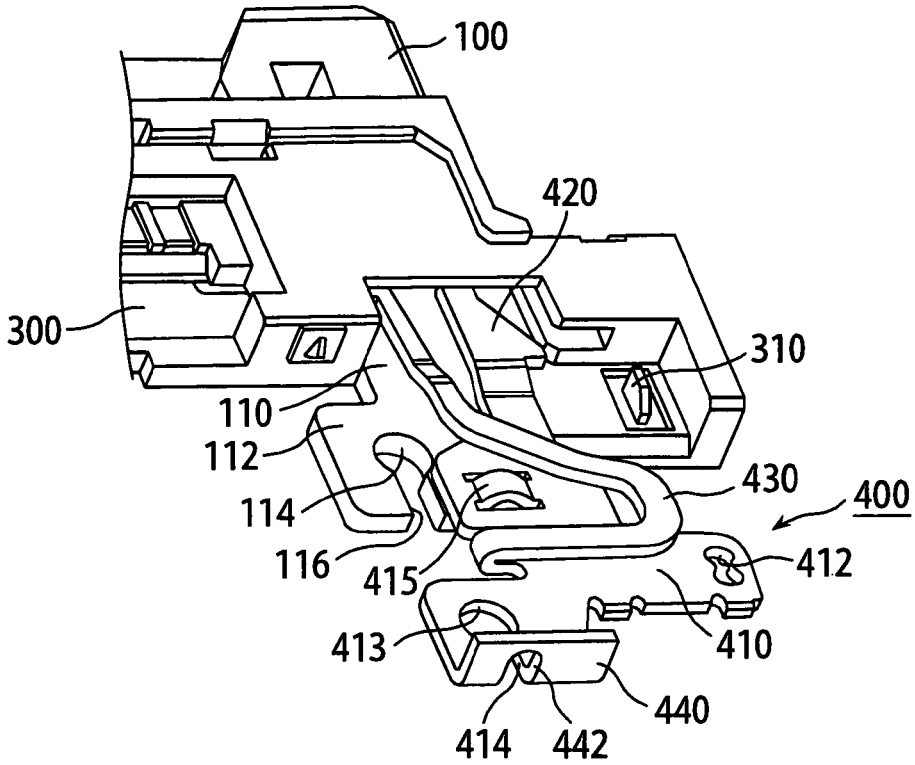
FIG. 5 is a partial, enlarged, perspective view showing the plug connector of FIG. 1, wherein the lock member is not installed in an insulator of the plug connector.
Figure 6:
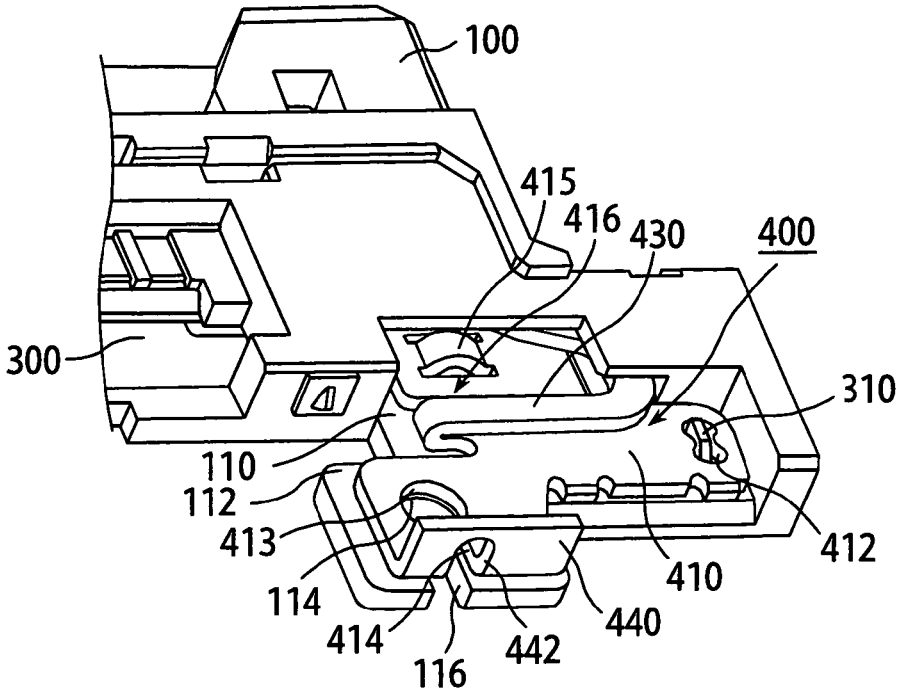
FIG. 6 is a partial, enlarged, perspective view showing the plug connector of FIG. 5, wherein the lock member is installed in the insulator of the plug connector.

With reference to FIGS. 2, 5 and 6, the insulator 100 is formed with accommodation portions 110. The accommodation portions 110 are positioned in the vicinity of opposite ends of the insulator 100 in a longitudinal direction of the plug connector, respectively. Each of the accommodation portions 110 is provided with a tab 112. The tab 112 is formed with a hole 114 and a slit 116. The slit 116 extends from the hole 114 to a rear end of the tab 112.

The base shell 300 is made of metal and formed with support portions 310. The support portions 310 are positioned nearer to the ends of the insulator 100 than the holes 114 in the longitudinal direction of the plug connector, respectively. In other words, for each accommodation portion 110, the support portion 310 is positioned between the hole 114 and the end of the insulator 100 in the longitudinal direction of the plug connector. The support portion 310 projects in the accommodation portion 110 along a thickness direction in which the plug connector has its thickness. The support portion 310 is a piece of a specific pentagonal shape, which is a shape obtainable by cutting off one corner of a rectangular. In other words, the support portion 310 has a beveled portion. The beveled portion of the support portion 310 faces rearwards. The support portion 310 is arranged perpendicular to the longitudinal direction of the plug connector. In this embodiment, the support portion 310 is formed as a part of the base shell 300. The present invention is not limited thereto. The support portion 310 may be formed distinct from the base shell 300.

Figure 4:
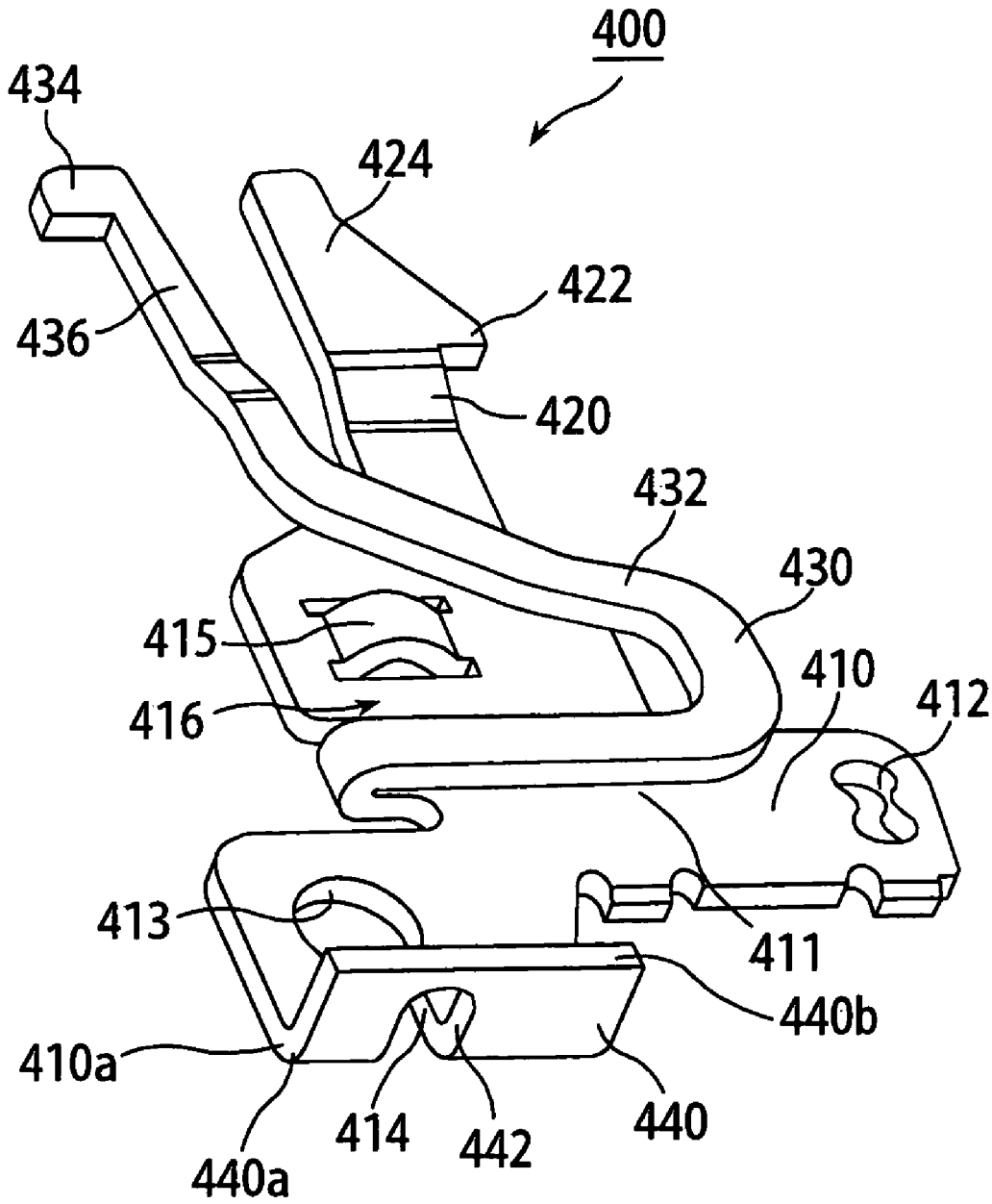
FIG. 4 is a perspective view showing a lock member which is included in the plug connector of FIG. 1.

With reference to FIG. 4, each of the lock members 400 is a single piece obtained by processing a single metal plate. The lock member 400 comprises a body portion 410, a lock portion 420, a spring portion 430 and an operated portion 440.

As shown in FIG. 4, the body portion 410 comprises a first predetermined portion 411 that has a plate-like shape. The first predetermined portion 411 is formed with a supported hole 412 that has a gourd-like shape or a shape similar to an outline of 8. Since the support portion 310 has the beveled portion facing rearwards, the beveled portion can guide the first predetermined portion 411 so that the support portion 310 is smoothly inserted into the supported hole 412. As the result of the insertion, the first predetermined portion 411 of the body portion 410 is freely supported by the support portion 310 so that the first predetermined portion 411 can move pivotally around the support portion 310. The combination of the support portion 310 and the supported hole 412 regulates a pivotal movement of the first predetermined portion 411 so that the first predetermined portion 411 is prevented from pivotally moving beyond a predetermined range. The supported hole 412 may have another shape such as an oval shape. It is however preferable that the shape of the supported hole 412 is the gourd-like shape, because the combination of the support portion 310 and the supported hole 412 of the gourd-like shape can regulate a movement of the lock member 400 along the longitudinal direction of the plug connector.

With reference to FIG. 4, the body portion 410 is further formed with a reception hole 413 and a slit (second slit) 414. The slit 414 extends from the reception hole 413 to a rear edge 410*a* of the body portion 410. As shown in FIG. 6, the reception hole 413 is positioned inside in the longitudinal direction of the plug connector, in comparison with the support portion 310. The reception hole 413 and the slit 414 correspond to the hole 114 and the slit 116, respectively, under a state where the lock member 400 is accommodated in the accommodation portion 110. The reception hole 413 has a size and a shape same as those of the hole 114. The slit 414 has a size and a shape same as those of the slit 116.

As shown in FIGS. 4 to 6, the body portion 410 is further provided with a first regulation portion 415. The first regulation portion 415 has a half-ellipse shape and protrudes upwards, i.e. in a first orientation towards the cover shell 500. The first regulation portion 415 is positioned forwards, in comparison with the supported hole 412, the reception hole 413 and the slit 414.

Figure 7:
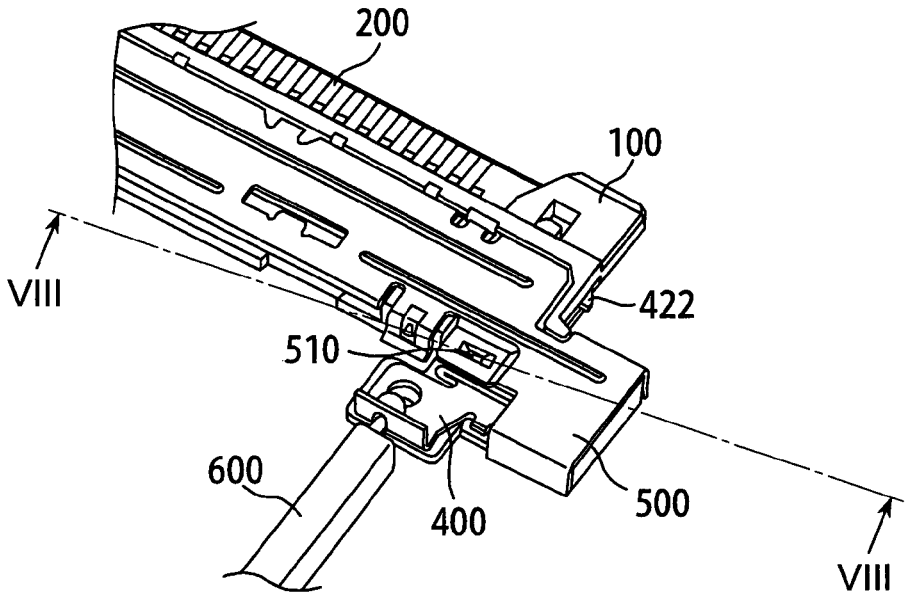
FIG. 7 is a partial, enlarged, perspective view showing the plug connector of FIG. 1.

With reference to FIG. 4, the lock portion 420 extends forwards from a front edge of the body portion 410. The lock portion 420 is provided with an end portion 424. The end portion 424 has a plate-like shape. The end portion 424 is parallel with the first predetermined portion 411 but is different in position from the first predetermined portion 411 in the thickness direction. The end portion 424 is provided with an engaging portion (engaging hook) 422. The engaging portion 422 is designed and arranged to be engaged with the engaged portion 930 of the receptacle connector. The lock portion 420 can move between a lock position and a release position in response to the pivotal movement of the body portion 410. As shown in FIG. 7, when the lock portion 420 is positioned at the lock position, the engaging portion 422 projects outwardly from the insulator 100 in the longitudinal direction of the plug connector so that the engaging portion 422 is engaged with the engaged portion 930 when the plug connector is mated with the receptacle connector. The engagement of the engaging portion 422 with the engaged portion 930 locks the mating state of the plug connector with the receptacle connector. On the other hand, when the lock portion 420 is positioned at the release position, the engaging portion 422 is accommodated in the insulator 100 so that the engaging portion 422 is disengaged from the engaged portion 930. The disengagement of the engaging portion 422 from the engaged portion 930 releases the locking of the mating state.

The spring portion 430 urges the lock portion 420 to move toward the lock position. The spring portion 430 extends from a side edge or a similar portion of the body portion 410 and is then folded so that the spring portion 430 comprises a second predetermined portion 432. The second predetermined portion 432 is parallel to the first predetermined portion 411 but is different in position from the first predetermined portion 411 in the thickness direction, i.e. a predetermined direction perpendicular to the first and the second predetermined portions 411, 432. The second predetermined portion 432 is arranged so that there is a space 416 between the second predetermined portion 432 and the first regulation portion 415. The second predetermined portion 432 is in contact with the first predetermined portion 411 in the thickness direction.

There may be a gap between the first and the second predetermined portions 411, 432; in this case, the gap is smaller than a half of the thickness of the first predetermined portion 411. The second predetermined portion 432 has a U-like or J-like shape. The second predetermined portion 432 may have a plurality of U-like or J-like shaped portions. As apparent from FIGS. 4 and 6, the second predetermined portion 432 of the U-like shape protrudes outwardly in the longitudinal direction of the plug connector beyond the lock portion 420. The first regulation portion 415 is positioned within a region defined by the second predetermined portion 432 of the U-like shape. As shown in FIG. 4, the spring portion 430 is further provided with an end portion 436. The end portion 436 extends forwards from the second predetermined portion 432 so that the end portion 436 has a portion that is laid on a plane same as the end portion 424. The end portion 436 is provided with a held portion 434. The held portion 434 is held by the insulator 100 within the accommodation portion 110. The held portion 434 may be freely held by the insulator 100. The above-explained spring portion 430 has a sufficient spring force, while the size of the lock member 400 is kept small.

The operated portion 440 is formed and arranged to force the lock portion 420 to move to the release portion when the operated portion 440 is operated. In detail, the operated portion 440 has a plate-like shape, as shown in FIG. 4. The operated portion 440 has a first edge portion 440*a* and a second edge portion 440*b*. The first edge portion 440*a* is connected to the rear edge 410*a* of the body portion 410 so that the operated portion 440 extends upwards from the body portion 410. The operated portion 440 is formed with a slit (first slit) 442. The slit 442 extends from the first edge portion 440*a* toward the second edge portion 440*b* but not to the second edge portion 440*b*. The slit 442 is connected to the slit 414. The slit 442 has a width same as that of the slit 414 in the longitudinal direction of the plug connector.

With reference to FIGS. 2 and 7, the cover shell 500 is provided with a second regulation portion 510. The second regulation portion 510 protrudes downwards, i.e. in a second orientation which is an orientation towards the base shell 300 and is opposite to the first orientation. When the lock portion 420 moves from the lock position to the release position upon the pivotal movement of the body portion 410, the first regulation portion 415 is brought into contact with the second regulation portion 510 so that the first and the second regulation portions 415, 510 prevent the lock portion 420 from moving beyond the release position. The second regulation portion 510 is arranged so that the second regulation portion 510 can receive the first regulation portion 415 with surface contact.

Figure 8:
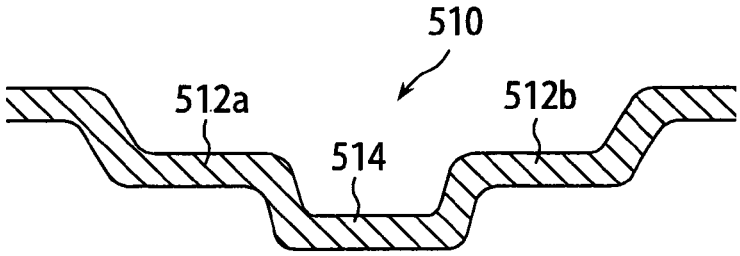
FIG. 8 is a cross-sectional view showing a second regulation portion of a cover shell included in the plug connector of FIG. 7, taken along lines VIII-VIII.
Figure 9:
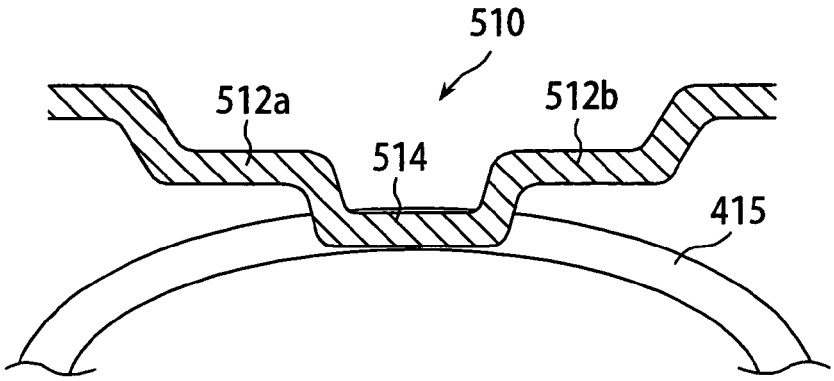
FIG. 9 is a view showing the second regulation portion of FIG. 8, wherein a first regulation portion is brought into contact with the second regulation portion upon a pivotal movement of the lock member.
Figure 10:
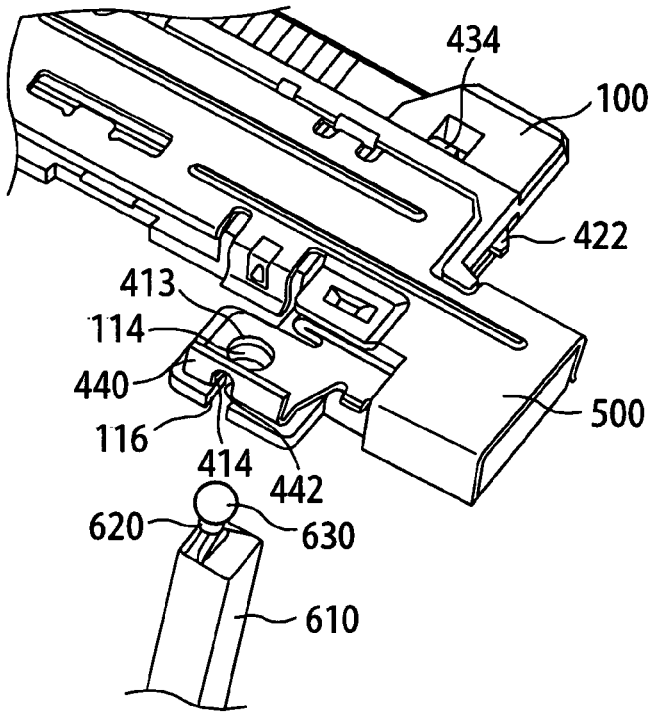
FIG. 10 is a partial, enlarged, perspective view showing the plug connector of FIG. 1, wherein the aid tool is not coupled to the plug connector.
Figure 11:
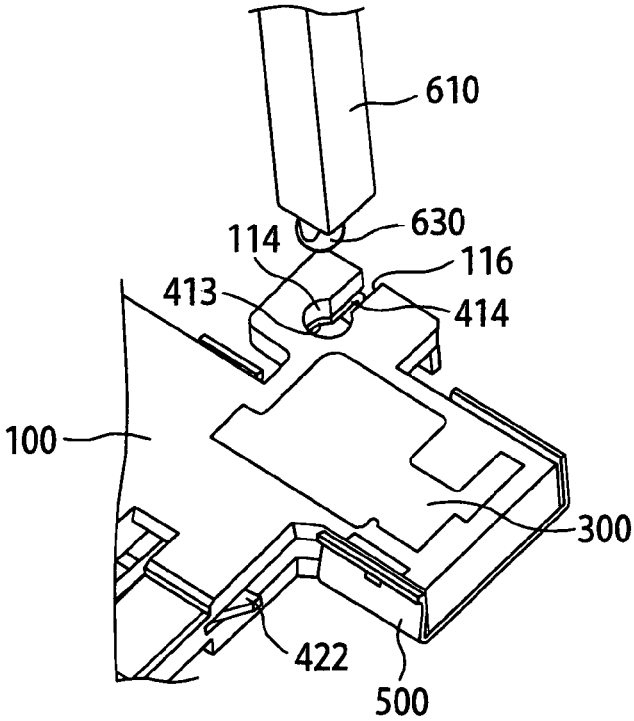
FIG. 11 is a partial, enlarged, perspective view showing the bottom of the plug connector of FIG. 10.
Figure 12:
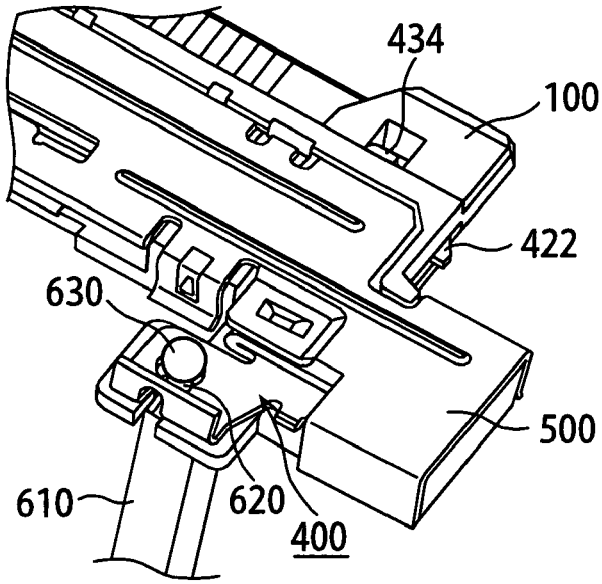
FIG. 12 is a partial, enlarged, perspective view showing the plug connector of FIG. 10, wherein the aid tool is being coupled to the plug connector.
Figure 13:
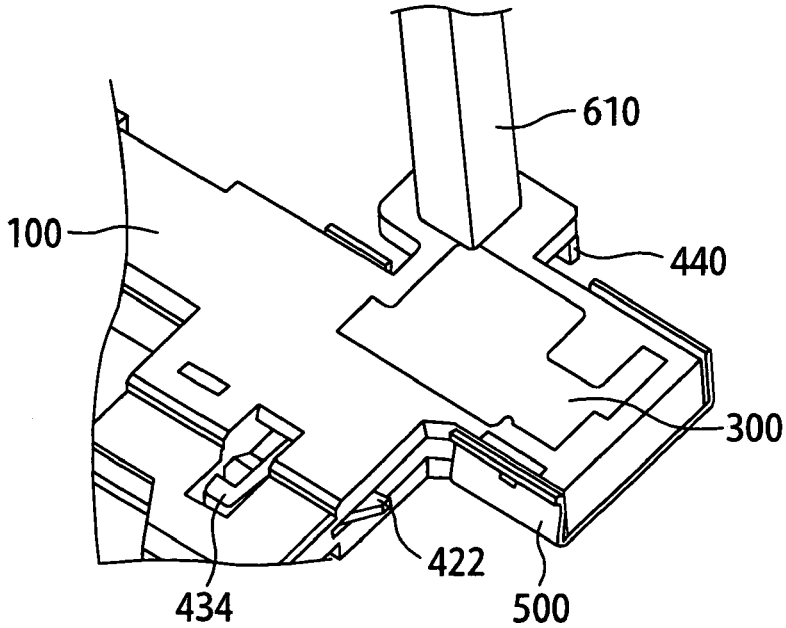
FIG. 13 is a partial, enlarged, perspective view showing the bottom of the plug connector of FIG. 12.

With reference to FIGS. 8 and 9, the second regulation portion 510 of the present embodiment comprises first protrusion portions 512*a*, 512*b* and a second protrusion portion 514. Each of the first protrusion portions 512*a*, 512*b* protrudes downwards. The second protrusion portion 514 further protrudes downwards from the first protrusion portions 512*a*, 512*b*. The first regulation portion 415 is brought into contact with only the second protrusion portion 514 between the first and the second protrusion portions 512*a*, 512*b*, 514.

The aid tool 600 is made of resin having elasticity. With reference to FIG. 2 the aid tool 600 comprises a main portion 610, neck portions 620 and head portions 630. The main portion 610 has an angular-U shape. The neck portions 620 are provided on opposite ends of the main portion 610. Each of the neck portions 620 has a thickness smaller than the widths of the slits 414, 442. Each of the head portions 630 has a spherical shape whose diameter is smaller than that of the reception hole 413 but larger than the width of the slits 414, 442.

With reference to FIGS. 10 to 15, explanation is made about an operation of the lock member 400 by using the aid tool 600.

Figure 14:
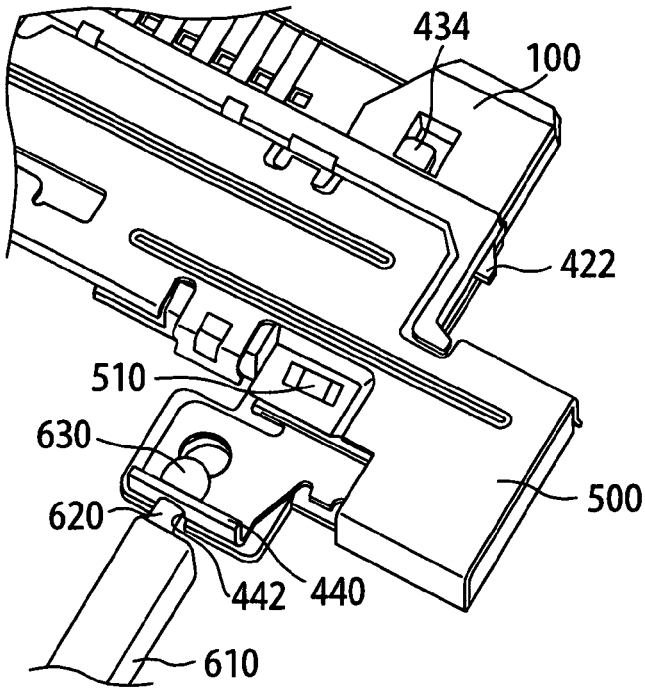
FIG. 14 is a partial, enlarged, perspective view showing the plug connector of FIG. 10, wherein the aid tool is coupled to the plug connector.
Figure 15:
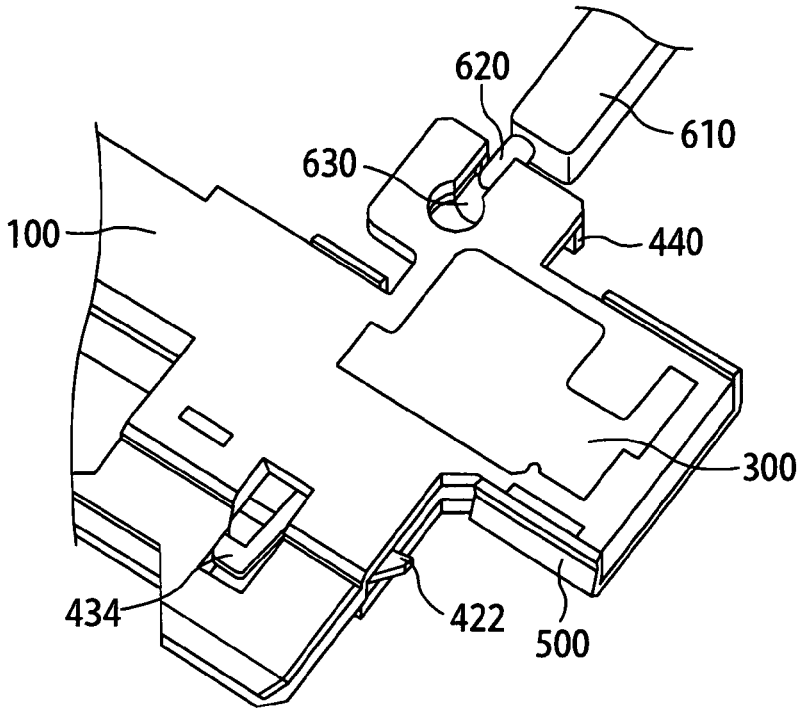
FIG. 15 is a partial, enlarged, perspective view showing the bottom of the plug connector of FIG. 14.

As understood from FIGS. 10 to 13, the head portions 630 of the aid tool 600 are inserted into the reception holes 413 from the bottom of the insulator 100. Then, the aid tool 600 is pivotally moved around the head portions 630 so that the main portion 610 is laid horizontally. As the result of the pivotal movement, the neck portions 620 are positioned in the slits 442, as shown in FIGS. 14 and 15. Under this state, when the main portion 610 is pulled rearwards, the lock members 400 move pivotally around the support portions 310 so that the locking of the mating state is released.

The present application is based on a Japanese patent application of JP2008-008478 filed before the Japan Patent Office on Jan. 17, 2008, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector which is matable with a mating connector having an engaged portion, the connector comprising a support portion and a lock member pivotally supported by the support portion, the lock member comprising:

a body portion comprising a first predetermined portion, the first predetermined portion having a plate-like shape and being supported by the support portion so that the first predetermined portion is pivotally movable around the support portion;

a lock portion being movable between a lock position and a release position in response to a pivotal movement of the body portion, the lock portion comprising an engaging portion which is engagable with the engaged portion, the engagement of the engaging portion with the engaged portion being locked when the lock portion is positioned at the lock position, while the engagement being released when the lock portion is positioned at the release position;

a spring portion urging the lock portion to move toward the lock position, the spring portion extending from the body portion, the spring portion having a second predetermined portion, the second predetermined portion being parallel to the first predetermined portion but being different in position from the first predetermined portion in a predetermined direction perpendicular to the first and the second predetermined portions; and an operated portion formed and arranged to force the lock portion to move to the release position when the operated portion is operated.

2. The connector according to claim 1, wherein the lock member is a single piece obtained by processing a single metal plate.

3. The connector according to claim 1, wherein the lock portion and the spring portion are arranged so that the support portion is not positioned between the lock portion and the spring portion.

4. The connector according to claim 1, wherein the first and the second predetermined portions are arranged so that the first and the second predetermined portions are brought into contact with each other or, even if there is a gap between the first and the second predetermined portions, the gap is smaller than a half of a thickness of the first predetermined portion.

5. The connector according to claim 1, wherein the second predetermined portion comprises at least one bent portion of U-like shape or J-like shape.

6. The connector according to claim 1, further comprising an insulator and a base shell, the insulator being formed with an accommodation portion accommodating the lock member, the base shell being made of metal, the support portion being formed as a part of the base shell.

7. The connector according to claim 6, wherein the base shell is held by the insulator upon a formation of the insulator through an insert-molding process.

8. The connector according to claim 1, further comprising a cover shell, the body portion being provided with a first regulation portion, the first regulation portion projecting in a first orientation along the predetermined direction, the cover shell being provided with a second regulation portion, the second regulation portion projecting in a second orientation along the predetermined direction, the second orientation is opposite to the first orientation, the first regulation portion being brought into contact with the second regulation portion when the lock portion moves from the lock position to the release position upon the pivotal movement of the body portion so that the first and the second regulation portions prevent the lock portion from moving beyond the release position.

9. The connector according to claim 8, wherein the second regulation portion comprises a first protrusion portion and a second protrusion portion, the first protrusion portion protruding in the second orientation, the second protrusion portion further protruding from the first protrusion portion in the second orientation, the first regulation portion being brought into contact with the second protrusion portion between the first and the second protrusion portions.

10. The connector according to claim 1, wherein the operated portion is operated by using an aid tool, the aid tool comprising a neck portion and a head portion, the neck portion having a first size as its thickness, the head portion having a spherical shape, the spherical shape having a second size as its diameter, the second size being larger than the first size, the body portion having an edge, the operated portion having first and second edge portions in the predetermined direction, the first edge portion of the operated portion being connected to the edge of the body portion, the operated portion extending along the predetermined direction, the operated portion being provided with a first slit, the first slit having a first width larger than the first size but smaller than the second size, the first slit extending from the first edge portion toward the second edge portion but not to the second edge portion, the body portion being provided with a second slit and a reception hole, the second slit having a second width equal to the first width, the second slit being connected to the first slit, the reception hole being connected to the second slit and having a predetermined diameter larger than the second size.

* * * * *